US009750337B2

(12) United States Patent
Carrera Gonzalez

(10) Patent No.: US 9,750,337 B2
(45) Date of Patent: Sep. 5, 2017

(54) PULL-OUT ASSEMBLY FOR FURNITURE, COMPRISING AN INLAY PLATE

(71) Applicant: Pöttker GmbH, Lippstadt (DE)

(72) Inventor: Daniel Carrera Gonzalez, Lippstadt (DE)

(73) Assignee: Pöttker GmbH, Lippstadt (DE)

( * ) Notice: Subject to any disclaimer, the term of this patent is extended or adjusted under 35 U.S.C. 154(b) by 0 days.

(21) Appl. No.: 15/143,828

(22) Filed: May 2, 2016

(65) Prior Publication Data

US 2016/0324308 A1 Nov. 10, 2016

(30) Foreign Application Priority Data

May 4, 2015 (DE) ..... 20 2015 102 256 U

(51) Int. Cl.

| | |
|---|---|
| ***A47B 1/04*** | (2006.01) |
| ***A47B 1/05*** | (2006.01) |
| ***A47B 1/10*** | (2006.01) |

(52) U.S. Cl.

CPC ..... *A47B 1/05* (2013.01); *A47B 1/10* (2013.01); *A47B 2001/053* (2013.01)

(58) Field of Classification Search

CPC ..... A47B 2001/053; A47B 1/05; A47B 1/10
See application file for complete search history.

(56) References Cited

U.S. PATENT DOCUMENTS

| | | | | | |
|---|---|---|---|---|---|
| 1,952,621 | A * | 3/1934 | Bromley | A47B 1/05 | 108/72 |
| 1,985,620 | A * | 12/1934 | Raphael | A47B 1/05 | 108/72 |
| 2,221,844 | A * | 11/1940 | Nonnast | A47B 1/05 | 108/26 |
| 2,229,320 | A * | 1/1941 | Balzano | A47B 1/05 | 108/25 |
| 2,577,724 | A * | 12/1951 | Weller | A47B 1/05 | 108/72 |
| 4,384,532 | A * | 5/1983 | Staff | A47B 1/05 | 108/72 |
| 2007/0289505 | A1 * | 12/2007 | Turenne | A47B 1/05 | 108/73 |

FOREIGN PATENT DOCUMENTS

| | | |
|---|---|---|
| DE | 9000271.7 U1 | 4/1990 |
| DE | 202010005991 U1 | 8/2010 |
| EP | 2742824 A1 | 6/2014 |

* cited by examiner

*Primary Examiner* — Hanh V Tran
(74) *Attorney, Agent, or Firm* — Richard M. Goldberg

(57) ABSTRACT

A pull-out assembly for furniture, having an inlay plate (12) which is guided along pull-out rails (14) by a lift fitting (16) in a manner to be liftable and lowerable, including a damper (32) for attenuating the movement of the inlay plate (12) when it reaches an end position in the lowered position.

5 Claims, 2 Drawing Sheets

PULL-OUT ASSEMBLY FOR FURNITURE, COMPRISING AN INLAY PLATE

BACKGROUND OF THE INVENTION

The invention relates to a pull-out assembly for furniture, having an inlay plate which is guided along pull-out rails by means of a lift fitting in a manner to be liftable and lowerable.

Such pull-out assemblies are frequently used for furniture in the form of tables or cupboards and have the purpose to extend the area of the work surface formed by the tabletop or worktop by the area of an inlay plate which can be stowed inside the furniture. In the lifted position, the inlay plate is flush with an edge of the worktop. When the inlay plate is to be stowed inside the furniture, it is lowered by means of the lift fitting into a position in which it is lower than the worktop and held in a position approximately in parallel with the worktop. Then, the inlay plate can be pushed back by means of the pull-out rail into a stowed position in which it is accommodated underneath the worktop, so that the furniture requires less space in this condition.

The lift fitting is usually configured such that it holds the inlay plate stably in the lifted position. However, when the inlay plate is pushed a certain amount towards its lowered position, either manually or by means of a drive mechanism, it falls, due to its own weight, into the lowered position in which the final position is limited by stops.

SUMMARY OF THE INVENTION

It is an object of the invention to provide a more convenient pull-out assembly.

According to the invention, this object is achieved by means of a damper for attenuating the movement of the inlay plate when it reaches the end position in the lowered state.

In conventional pull-out assemblies of this type, an impact noise and vibrations are produced when the inlay plate drops into the lowered position and impinges on the stops when it reaches the end position. The invention permits to dampen this impact so that the impact noise is reduced or eliminated completely. At the same time, mechanical shocks are avoided and the strain on the mechanical components of the lift fitting and the pull-out guide assemblies is reduced.

Useful details of the invention are indicated in the dependent claims.

The damper may be a hydraulic or preferably pneumatic piston/cylinder unit.

Preferably, the lift fitting is designed such that the inlay plate, on its path from the lifted position into the lowered position, makes a movement in a downwardly and inwardly inclined direction. In this case, the damper may be mounted in a lying, i.e. essentially horizontal position on one of the pull-out rails so that it forms a resilient stop for a member that is rigidly connected to the inlay plate.

BRIEF DESCRIPTION OF THE DRAWINGS

Embodiment examples will now be described in greater detail in conjunction with the drawings, wherein.

DETAILED DESCRIPTION

Figure 1:
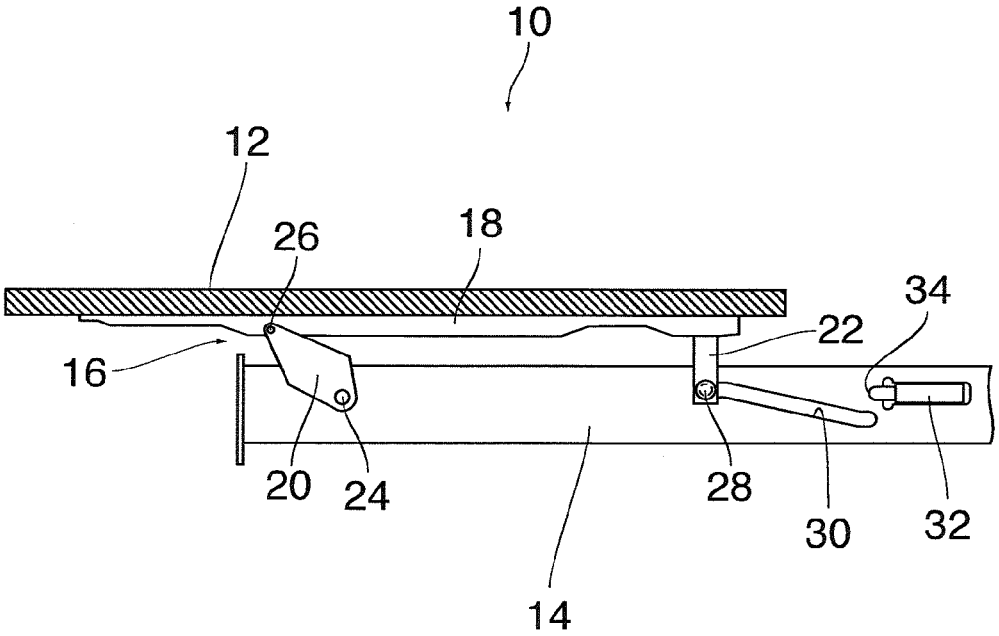
FIG. 1 is a side view of a pull-out assembly for furniture according to the invention.

The pull-out assembly 10 shown in FIG. 1 has so-called inlay plate 12 which is mounted on two parallel pull-out rails 14. The pull-out rails, only one of which is visible in FIG. 1, support the inlay plate 12 at its opposite lateral ends.

At the bottom side of the inlay plate 12, a lift fitting 16 is provided by which the inlay plate is guided to be movable relative to the pull-out rails 14. The lift fitting 16 has two identical or mirror-symmetrical sub-assemblies each of which is associated with one of the pull-out rails 14. Each sub-assembly comprises a support 18 mounted on the bottom side of the inlay plate 12 and connected to the pull-out rail 14 via an articulated link 20 and a rigid post 22. The link 20 is disposed near the outward end of the pull-out rail 14 and is pivotable relative to the pull-out rail about a first joint 24 and relative to the support 18 about a second joint 26.

The post 22 is disposed at the end of the support 18 that points inwardly in the push-in direction of the pull-out rails 14 and extends vertically downward from the support. The lower end of the post 22 carries a horizontally projecting stud 28 which is guided in a guide contour 30 that is formed in the pull-out rail 14. In the position shown in FIG. 1, the stud 28 is stably held in a horizontal portion of the guide contour 30. From this horizontal portion, the guide contour slants downwardly in push-in direction of the rails 14, and the slanting part merges into another short horizontal portion at the inward end.

The link 20 and the post 22 support the inlay plate 12 in a horizontal posture. In the pull-out direction, the top joint 26 of the link 20 is offset outwardly from the joint 24. The stud 28 engages the end of the guide contour 30 and prevents a further movement of the inlay plate 12 to the left in FIG. 1 and thereby prevents a tilting movement of the link 20 in counter-clock sense under the weight of the inlay plate 12.

When the inlay plate 12 is to be moved into the lowered position, it is gently pushed in push-in direction, whereby its outer end (on the left side in FIG. 1) is temporarily lifted to some extent, due to the pivoting movement of the link 20, whereas the stud 28 reaches the slanting portion of the guide contour and slides down along this slanting portion. Optionally, the stud 28 may be configured as a roller for reducing friction.

As soon as the link 20 has exceeded its dead center, the inlay plate 12 moves autonomously into the lower position due to its own weight. In this phase, the link 20 pivots further clock-wise, and the stud 28 slides towards the lower and inner end of the guide contour 30.

However, before the inlay plate 12 reaches its lower end position and the stud 28 impacts at the end of the guide contour 30, the movement is attenuated by a pneumatic damper 32 that is mounted on the pull-out rail 14. The damper is a piston/cylinder unit or pneumatic spring having a ram 34 connected to the piston of the piston/cylinder unit, the ram being shown in an extended position in FIG. 1. Towards the end of the downward movement of the inlay plate 12, the post 22 or a member connected to this post engages the end of the ram 34, so that the movement of the stud 28 in the guide contour 30 and, accordingly, the entire movement of the inlay plate 12 is braked gently until the inlay plate finally comes to rest in its lower end position—or shortly before reaching this end position, as the case may be.

In principle, it is sufficient when the damper 32 is provided only on one of the two pull-out rails 14. Optionally, however, dampers may be provided on both pull-out rails.

For reasons of stability it may be advantageous when the stud 28 or the member that engages the end of the ram 34 is configured as a continuous rod that interconnects the posts 22 at the opposite ends of the inlay plate. The same applies to the joint axle of the joint 24.

FIGS. 2 to 5 show the pull-out assembly 10 in a mounted state in a cupboard 36 having a body 38 and a worktop 40. The pull-out rails 14 form parts of respective pull-out guide assemblies 42 which further comprise a guide rail 44 that is secured at a side wall of the body and guides the pull-out rail 14.

Figure 2:
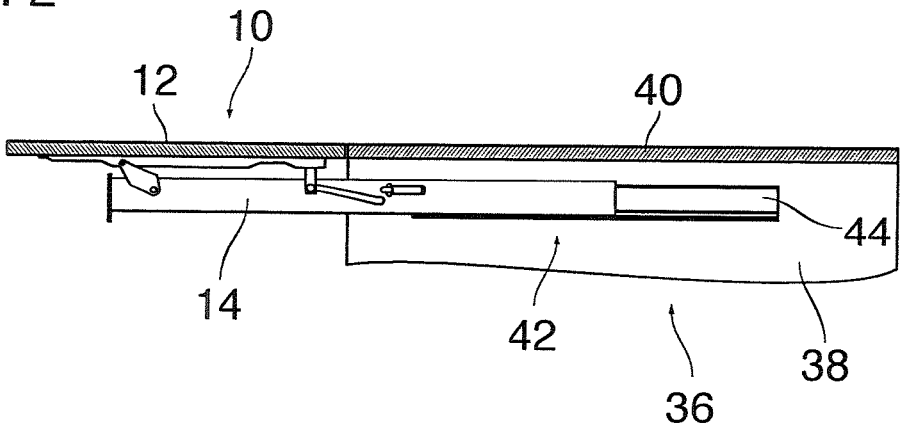
FIGS. 2 to 5 are schematic sectional views of a top part of a furniture item with the pull-out assembly according to the invention in different positions.

In FIG. 2, the inlay plate 12 abuts at the worktop 40 and is flush therewith.

Figure 3:
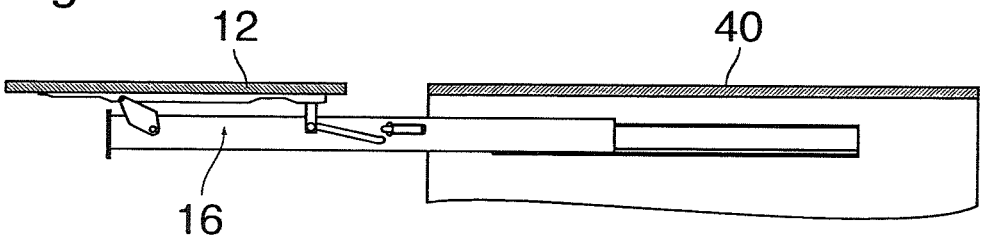

When the inlay plate 12 shall be stowed below the worktop 40, the pull-out assembly is at first drawn out further, so that the inlay plate 12 retreats further from the front edge of the worktop 40, as has been shown in FIG. 3. In this way, the necessary space for the movement of the lift fitting 16 is provided.

Figure 4:
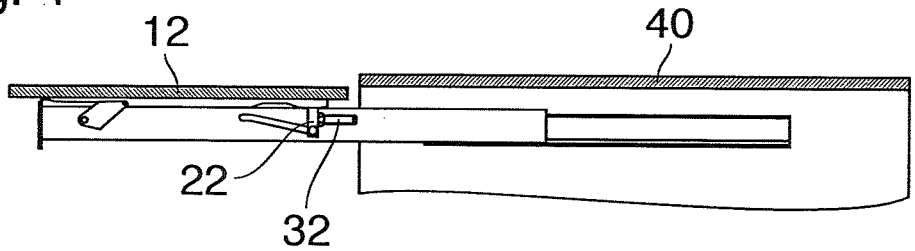
Figure 5:
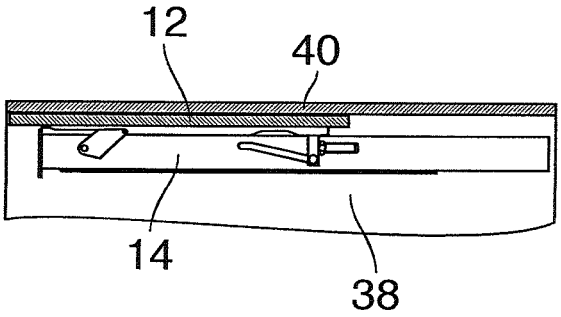

FIG. 4 shows a phase of the movement in which the inlay plate 12 has reached its lowered position and the member connected to the post 22 engages the damper 32 and compresses the same. Then, the top surface of the inlay plate 12 is in a position lower than the bottom side of the worktop 40, so that the inlay plate 12 may be pushed back into the interior of the body 38 together with the pull-out rails 14, as has been shown in FIG. 5.

The invention claimed is:

1. A pull-out assembly for furniture, comprising:

an inlay plate, pull-out rails, a lift fitting which connects the inlay plate to the pull-out rails for guiding the inlay plate along the pull-out rails in a manner that the inlay plate is adapted to be liftable and lowerable, and a damper for attenuating movement of the inlay plate before the inlay plate reaches a lowered end position, wherein the lift fitting is configured to guide the inlay plate in a slanting downward and inward movement along a pull-out axis of the pull-out rails from a lifted position into the lowered position, wherein the damper is mounted in an essentially horizontal position at one of the pull-out rails and the inlay plate is rigidly connected to a member arranged to abut the damper before the inlay plate reaches the lowered end position.

2. The pull-out assembly according to claim 1, wherein the damper is a pneumatic damper.

3. The pull-out assembly according to claim 1, wherein the inlay plate has a downwardly projecting post as part of the lift fitting which is guided in a guide contour formed in one of the pull-out rails.

4. The pull-out assembly according to claim 1, wherein the inlay plate is articulated to a link as part of the lift fitting which is itself articulated to the pull-out rail.

5. The pull-out assembly according to claim 3, wherein:

the inlay plate is articulated to a link as part of the lift fitting which is itself articulated to the pull-out rail, and in a pull-out direction of the rails, the post is arranged at an inner end of the inlay plate and the link is arranged at an outer end of the inlay plate.

* * * * *